United States Patent [19]

Tobler

[11] Patent Number: 5,056,866

[45] Date of Patent: Oct. 15, 1991

[54] ROCKING CHAIR, PARTICULARLY OFFICE CHAIR CONSTRUCTION

[75] Inventor: Peter Tobler, Sennwald, Switzerland

[73] Assignee: Sitag AG, Senwald, Switzerland

[21] Appl. No.: 580,635

[22] Filed: Sep. 10, 1990

[30] Foreign Application Priority Data

Sep. 21, 1989 [CH] Switzerland ..... 03436/89

[51] Int. Cl.[5] ..... A47C 3/026

[52] U.S. Cl. ..... 297/302; 297/304

[58] Field of Search ..... 297/302-304; 248/575, 372.1

[56] References Cited

U.S. PATENT DOCUMENTS

| | | | |
|---|---|---|---|
| 4,235,408 | 11/1980 | Sapper | 297/302 |
| 4,589,697 | 5/1986 | Bauer et al. | 297/347 |
| 4,729,539 | 3/1988 | Nagata | 248/575 |
| 4,832,402 | 3/1989 | Zund . | |

FOREIGN PATENT DOCUMENTS 3335463 4/1985 Fed. Rep. of Germany .

*Primary Examiner*—Peter R. Brown
*Assistant Examiner*—Milton Nelson, Jr.
*Attorney, Agent, or Firm*—Frishauf, Holtz, Goodman & Woodward

[57] ABSTRACT

To provide for a compact seat adjustment mechanism, an elongated seat support (21) is secured to a floor support structure including a central post (13), to extend at an upwardly directed angle of inclination. The seat (17), attached to a seat support (29), is pivotally located to pivot about an axis (37) close to the front edge of the seat. The seat is maintained in position by a torsion spring assembly (23), the spring tension of which is adjustable by a laterally positionable adjustment knob (63), and a blocking element in form of a gas spring or hydraulic spring (27) couples the seat to the seat support, the respective blocking element being attached with a first end between the pivot axis support and the floor support and with its other end to the seat (17) such that it will extend in the genral direction of the elongated seat support (21) and form an acute angle with respect to the seat support, which angle will be somewhat greater than the angle of inclination of the seat support (210 itself. The bias of the torsion spring (39) of the torsion spring system can be changed by adjusting the position of a setting arm (45) by a wedge on a rotatable spindle, coupled to the adjustment knob (63). The construction places the mechanism parts close to the seat and permits a generally pleasing, clean appearance, while permitting adjustment of spring tension and blocking by the user, while seated on a chair. Uncoupling the respective blocking element at one end, for example by removal of a bolt, permits tilting the seat back about the tilt axis (37) by approximately 180°, and providing access for service to the chair mechanism.

20 Claims, 3 Drawing Sheets

ROCKING CHAIR, PARTICULARLY OFFICE CHAIR CONSTRUCTION

Reference to related patents, the disclosures of which are hereby incorporated by reference.

U.S. Pat. No. 4,832,402, Zünd (to which European 0 281 749 corresponds)

U.S. Pat. No. 4,589,697 (to which German 33 35 463 corresponds)

U.S. Pat. No. 4,235,408, Sapper.

Reference to related application, by the inventor hereof and assigned to the assignee of the present application, the disclosure of which is hereby incorporated by reference: U.S. Ser. No. 07/580,278, filed Sept. 10, 1990 Tobler.

FIELD OF THE INVENTION

The present invention relates to a chair construction, and more particularly to an office chair having a rocking mechanism secured to a center post, so that the chair can be swivelled about a swivel axis coaxial with the post, and, additionally, can be tipped or tilted about a tipping or tilting axis, and especially to a mechanism to maintain the chair in predetermined, resiliently adjustable positions, from which it can be tilted.

BACKGROUND

Various seat constructions of office chairs, customarily known as swivel chairs, include an inclined support structure which extends at an angle from a central support post, and uses a torsion spring between the support structure and the seat itself, the torsion spring being arranged to bias the seat into an upper tilted position. The spring tension of the torsion spring can usually be changed and a blocking arrangement between the support and the seat is provided in order to lock the seat in position in at least two different tilted angles. Chairs of this type have been commercially available for about two decades. The support extending from the central post of these known chairs is relatively short and, hence, if the seat is deflected downwardly, the forward portion of the seat will raise up. If the user is not very tall, or the support post is at a high level, the user may lose floor contact with his feet. This is frequently found undesirable by users, since a sense of instability is conveyed by loss of floor contact.

The chairs of this construction have another disadvantage, in that the blocking device has only a lower blocking position and an upper blocking position, so that the chair cannot be locked in desired intermediate positions. The tension of the torsion spring can be changed by the user in depedence of the weight of the user. Usually, however, adjustment screws for such a device are located far below the seat and inaccessible while the user is actually using the seat. Thus, the adjustment screw can be adjusted only when the user is off the chair, then the chair must be tried, the screw again re-adjusted, and so on. This continued on-off and trial-by-error adjustment is awkward and time-consuming.

The referenced U.S. Pat. No. 4,832,402, Zünd, describes a chair which has an attachment plate to which a seat structure can be secured. The attachment plate can be tilted about a horizontal tilt axis at the forward side thereof, and is tiltably secured to an upwardly inclined support structure. A gas spring extends between the support structure and the carrier plate, projecting at an approximately right angle from the support structure. This gas spring operates as a spring which has the tendency to move the attachment plate from a lower tilt position to an upper tilt position, and, additionally, to function as a blocking arrangement to block the attachment plate and the seat secured thereto in any desired tilt position, in accordance with an adjustment made by the user. A spiral spring is located coaxially to the gas spring, and the bias of the spiral spring can be adjusted by a double-arm lever, controlled by a wing nut, in accordance with the weight of the user. The wing nut is located beneath the seat, and thus adjustment thereof cannot be carried out while the user is seated on the chair.

The chair of this construction, in spite of the inaccessibility of the adjustment for the spiral spring, does not present a clean appearance since both the gas spring as well as the spiral spring are readily visible from the side. This is unsatisfactory from an aesthetic point of view and this disadvantage has been found particularly annoying when office equipment is considered which should not only be functional but also of pleasing appearance design.

The chairs of the prior art, in general, have a disadvantage with respect to maintenance or repair. In actual practice, the elements of chairs which wear out, besides the upholstery, are the adjustment mechanism. The adjustment mechanisms of many modern chairs operate for years without any service problems; yet, from time to time an element such as the gas spring or other movable parts require replacement or joints have to be oiled or greased. The inaccessibility of replacement parts and of moving connections or joints, which should be maintained, contribute to lack of proper maintenance.

THE INVENTION

It is an object to provide a chair, and particularly a rocking or tilting office swivel chair, in which the disadvantages of known chairs are largely avoided and, particularly, which can be made to be of generally pleasing design and still meet all requirements of office chairs in general. Further, the chairs should be user-friendly and easy to be serviced and maintained.

Briefly, the blocking element for the chair seat is a fluid blocking spring, for example a gas spring—although it may be a hydraulic fluid element—which is secured to a, typically upwardly inclined seat support structure at a position between the forward end portion thereof and the rear end portion, for example approximately midway therebetween; it is additionally secured, with its other end, to the seat or seat attachment frame or plate at a position such that the blocking element extends in the general direction of the seat support, and forms an acute angle with respect to the seat support.

The seat support, typically, is upwardly inclined; by positioning the fluid spring as described, it will have a larger angle of inclination with respect to the center post than the seat support. This has the advantage that the gas spring or hydraulic spring element can be placed for a considerable distance within the confines or a side plate of the seat support, so that it is effectively hardly visible, and, where exposed, is so close to the seat itself that it is outside of the line of vision of most adults because of the extent of the seat structure. The forward seat portion and the attachment plate are preferably coupled by a torsion spring, so that additional biassing thereof can be readily obtained by adjustment of the torsion spring, and a spiral spring in addition to the gas spring then will not be necessary. The structural arrangement then permits development of a particularly pleasing appearance design.

In accordance with a preferred feature of the invention, the bias of the torsion spring can be changed by a wedge, the position of which is adjustable by a positioning screw. The wedge may, itself, transfer the force of the torsion spring to the seat. Adjustment of the bias, thus, is simple and can be comfortably carried out by the user. It is then possible to so arrange the adjustment screw beneath the seat that an adjustment head or knob is located at one side of the seat. The lateral position of the adjustment knob permits simple manipulation thereof by the user of the chair while he/she is seated thereon. The adjustment knob, thus, upon rotation, can be used to match the bias of the torsion spring to the weight of the user. In accordance with a particularly preferred embodiment, the shaft of the adjustment screw is axially shiftable, but rotationally coupled to an inner portion thereof. Thus, for adjustment, the knob can be pulled out laterally so that it can be easily accessible while the user is seated, and pushed under the seat when the adjustment has been effected. Interference of access to the chair, or the possibility of catching loose clothing on the knob are thereby avoided.

In accordance with another preferred feature of the invention, the attachment plate of the seat is coupled to the gas spring or the hydraulic blocking element by a releasable attachment bolt, so that it is possible, upon release of the gas spring from the attachment bolt, to pivot the entire seat about the axis of the torsion spring, that is, about its tilt axis, by about 180°, so that the back of the back of the seat will then be placed forwardly of the seat post and the mechanism exposed, for example for service, maintenance or lubrication.

The tilt axis for the seat is preferably placed in the immediate vicinity of the front edge of the seat, just sufficiently behind the front edge of the upholstery, for comfort. This has the additional advantage that, upon tilting of the chair, the front edge of the seat is not raised by any substantial degree, and floor contact of the user's legs is not lost.

In accordance with another preferred feature, the support, torsion spring, the torsion spring bias adjustment arrangement, the fluid blocking element and the seat frame form a single structural unit. This has substantial advantages when the chair is manufactured, since the entire unit can be quickly placed on a spider or ground support and a central post, and assembly of the seat structure with the floor support is fast and readily accomplished.

In accordance with another preferred feature of the invention, the torsion spring is formed by a torsion rod which extends as long as possible, and effectively over the entire width of the seat. Each one of the ends of the torsion rods can then be coupled with a stub pipe or tubular element, located effectively coaxially to the torsion rod. One of these tubular elements is coupled to a force transfer arm, and the other is coupled to the support. The seat support plate, or seat structure, is pivotably located on the pipe or tube elements, secured to one and tiltable about the other, which results in a very compact construction. The arrangement permits constructing the torsion rod with a substantial length, almost as long as the width of the seat, so that it has the advantage of particularly good spring characteristics. Preferably, the tubular element which is coupled to the force transfer arm is rotatably located with one end on the support, to result in a particularly stable construction.

DRAWINGS

DETAILED DESCRIPTION

Figure 1:
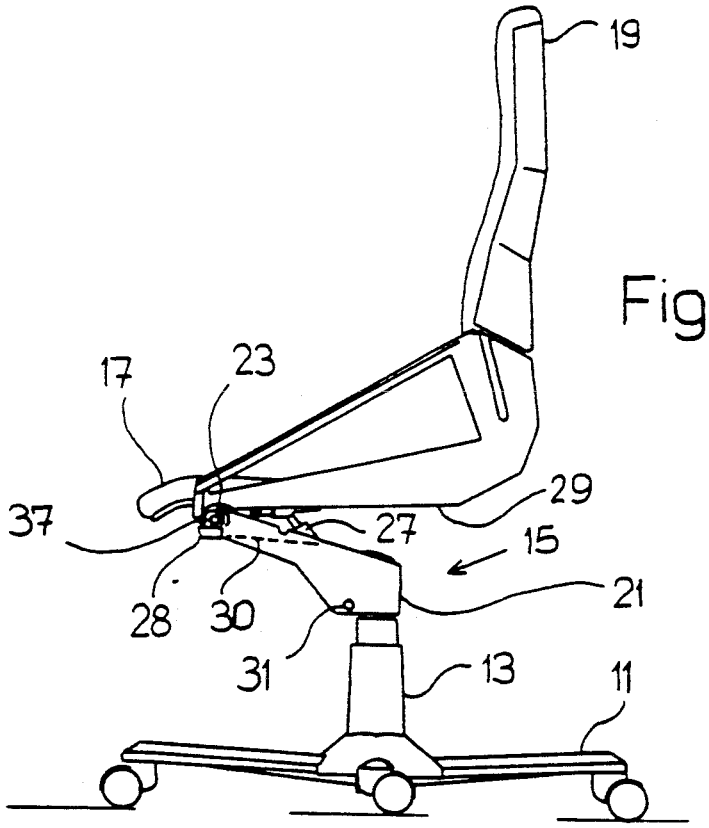
FIG. 1 is a highly schematic side view of a rocking swivel-type office chair incorporating the present invention.
Figure 2:
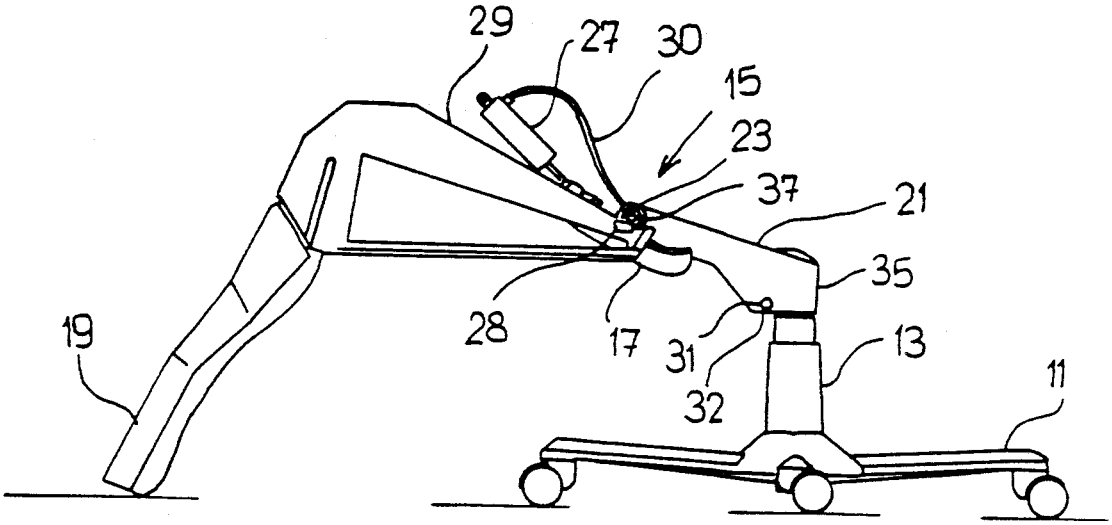
FIG. 2 is a view similar to FIG. 1, with a release element uncoupled, in which the chair seat and back are tilted forward, to permit service work.

Referring first to FIGS. 1 and 2: A floor support includes a spider 11 and a center post 13. A seat support unit 15 is secured to the center post 13. A seat unit 17, which may include a back rest 19, is secured to the seat support unit 15. Preferably, the back 19 is coupled with the seat 17 by resilient elements or the like. The seat 17 may include a unitary structure, for example of the type shown and described in copending application: U.S. Ser. No. 07/580,278, filed Sept. 10, 1990, TOBLER.

Figure 3:
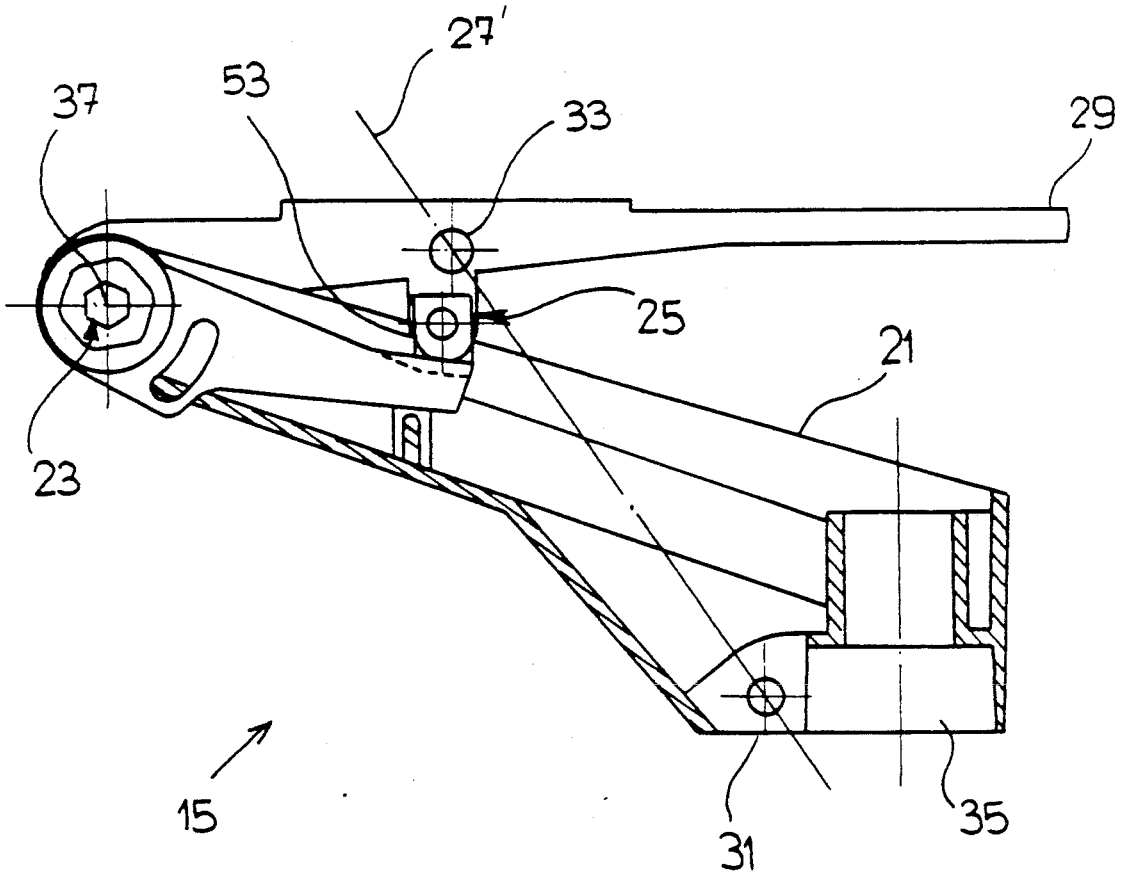
FIG. 3 is a schematic fragmentary view of the unit comprising a support, torsion spring, seat frame, spring adjustment elements for the fluid operating spring, and indicating the position of the fluid spring in chain-dotted representation, with the angular relation approximately to scale.
Figure 4:
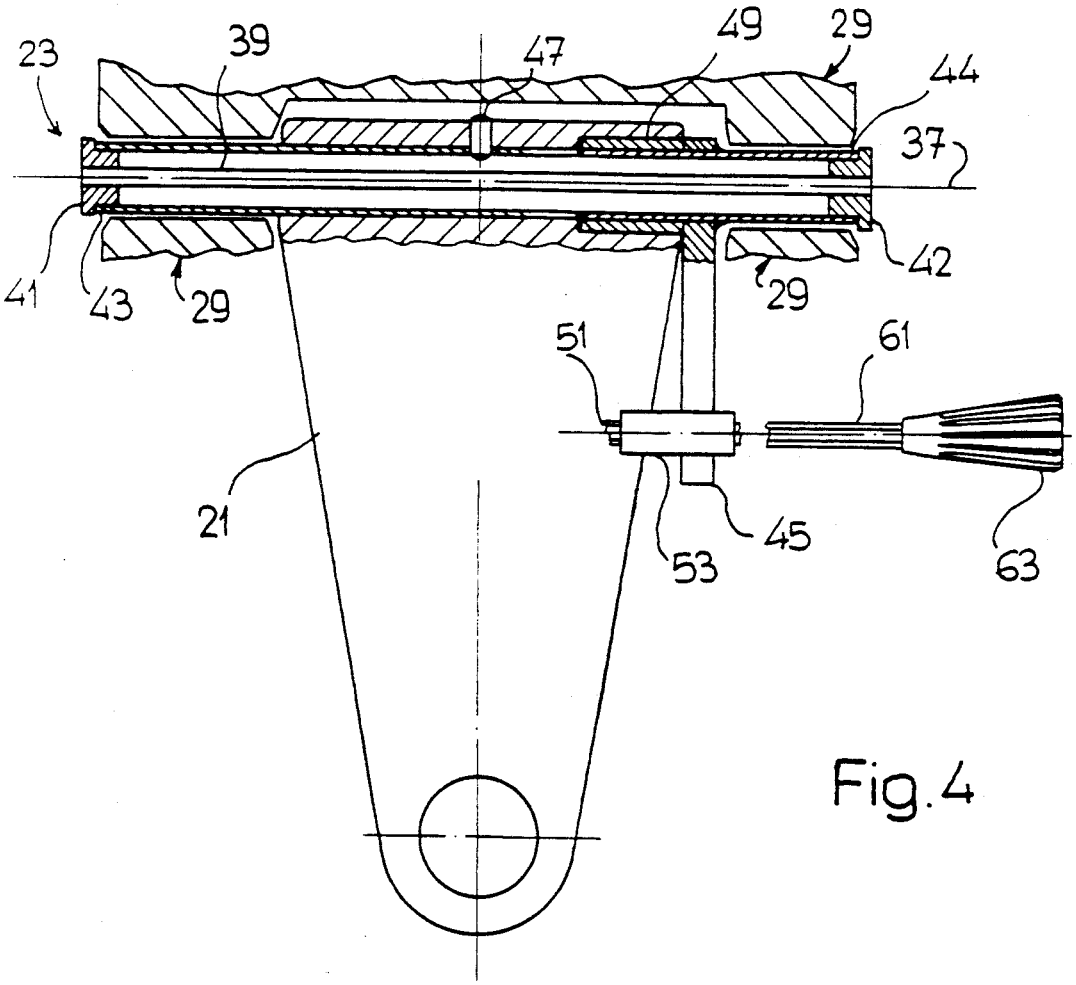
FIG. 4 is a fragmentary schematic side view of the torsion spring and the bias adjustment therefor.
Figure 5:
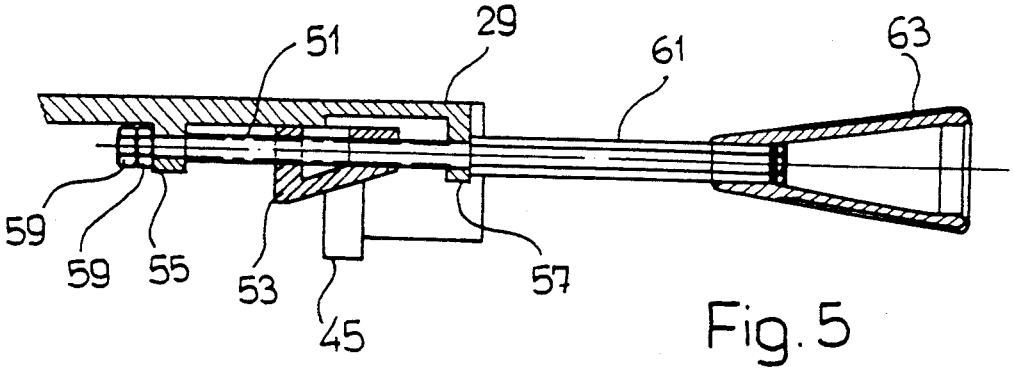
FIG. 5 is a fragmentary detailed view, in cross section, of the torsion spring bias adjustment arrangement.

Unit 15 is best seen in FIGS. 3–5. Essentially, unit 15 includes a support or support structure 21, a torsion spring arrangement 23, adjustment means 25 to set the bias of the torsion spring 23, a blocking apparatus 27 (FIGS. 1, 2) and the seat frame 29. The blocking arrangement 27, which may be a gas spring or a hydraulic blocking element, is shown in FIG. 3 only schematically by the chain-dotted connecting line 27'. The blocking element is coupled at its respective ends to link joints 31 and 33. The blocking element 27 may be a rigid or elastically blockable gas spring, or a hydraulic blocking element. Gas springs of this type are commercially known under the designation B-O-L. A hydraulic blocking element is sold commercially under the trade name "HYDROBLOC".

The blocking arrangement 27 can be controlled by a pushbutton 28 (FIGS. 1, 2) which is coupled by a Bowden cable 30 to the blocking element as such. This is the preferred construction since it permits control of the blocking element from the side of the seat, by an essentially inconspicuous device; it is equally possible to utilize a link or lever mechanism to operate the gas spring or other selected blocking element 27.

The support 21—see FIG. 3—includes a flange 35 to attach the support 21 to the center post 13. The support 21 extends at an upward inclination, see FIG. 3, towards a region close to the front of the seat. The seat frame 29, or an equivalent attachment plate or the like, is pivotably connected with one end to the support element 21. The pivot axis 37, FIG. 3, permits tilting of the seat frame 29 thereabout. The axis 37 is as close to the forward edge of the seat as possible, considering the upholstery and structure thereof, see FIGS. 1, 3 and 4.

The torsion spring arrangement 23 is best seen with reference to FIGS. 4 and 5. It includes a torsion rod 39 (FIG. 4) which, effectively, extends across the entire width of the seat. A pin attachment element 41, of the torsion rod 39 couples the torsion rod 39 with essentially coaxial tubular element 43. A pin attachment element 42 couples the torsion rod 39 at the other end to another coaxial tubular element 44. A force transfer arm 45 is securely attached to the tubular element 44. The tubular element 43 is coupled by a coupling pin 47 to the support structure 21. The tubular element 44 can rotate with respect to the support 21. A bearing bushing 49 between element 44 and support 21 permits rotation of the element 44 with respect to support 21.

The torsion spring rod 39 can be pre-biassed or prestressed by an adjustment screw 51 (FIGS. 4, 5) which acts on a wedge 53, on which the force transfer arm 45 is engaged. Adjustment screw 51 is rotatably secured on seat frame 29. The force transfer arm 45, coupled to the tubular element 44 at an inner region thereof, and hence to the torsion rod 39, has the tendency to tilt the seat frame 29 in an upward direction. Such a movement is counteracted by the fluid spring 27, unless it is unlocked or unblocked by the user of the chair.

The adjustment screw 51 is rotatably located in the seat frame 29 by passing through two projecting eyes 55, 57. Nuts 59 positively locate the screw within its support openings in the eyes 55, 57. The screw 51 terminates in a shaft 61 which is polygonal, for example of hexagonal cross section. An adjustment knob 63 is axially slidable on the shaft 61. The shaft 61 terminates preferably within the outline of the seat shell 17. To operate the screw 51, the adjustment knob 63 can be pulled outwardly in the position shown in FIG. 5, where it is accessible to a user sitting on the chair, and the user can then rotate the adjustment knob 63 to adjust the bias of the torsion spring rod 39 to the weight of the user.

USE AND OPERATION (1) Seat Adjustment

The force transfer arm 45 (FIGS. 4, 5) of the torsion spring arrangement 23 applies a force on the wedge 53. Wedge 53 transfers the force on the seat frame 29 and hence on the seat unit 17. This force has the tendency to tilt the seat 17 in an upwardly tilted position about axis 37, by tilting about tubular element 43. This corresponds, in general, to the position shown in FIG. 1. Ordinarily, and for use, the seat 17 may be in a somewhat lower tilted position, being blocked in the somewhat lower tilted position by blocking of the fluid spring 27, or other suitable blocking arrangement. To unlock the blocking arrangement, the user can press the button 28, so that, via the Bowden cable 30 or a hydraulic or pneumatic connection, or a lever mechanism, the blocking element 27 is unlocked or de-blocked. By changing the weight distribution, the user can then move the seat in the desired position, for example by rising slightly, or sitting further backwardly. Upon releasing the button 28, the seat 17 is then blocked or locked in the respectively set position.

The torsion spring arrangement 23 can be matched to the weight of the user by setting the pre-tension of the spring. To change the tension, the user need only reach under the seat 17 and pull out the adjustment knob 63 along the shaft 61 until the knob reaches its terminal position shown, for example, in FIG. 5. Then, upon rotation of the knob 63, the spindle 51, in a threaded opening in the wedge 53, changes the wedging position of the wedge on the force transfer arm 45 which, like the wedge, has an inclined surface. Upon shifting the wedge towards the right, with respect to FIG. 5, the force transfer arm 45 is pushed downwardly, which pre-tensions the torsion spring 39 to a greater extent. When the user, then, operates the pushbutton 28, the seat 17 is raised with a greater force than before. Rotating the knob 63 in the opposite direction shifts the wedge 53 towards the left (FIG. 5), permitting the force transfer arm 45 to shift upwardly, and decreasing the pre-tension spring setting of the torsion spring arrangement 23. The user, thus, can match the position of the chair to the user's weight. After adjustment, the knob 63 can be pushed along the shaft 61 towards the left to be effectively hidden underneath the seat structure 17.

Chairs which have a purely mechanical spring compensation for the weight may cause accidents.

During routine office cleaning or under other conditions, it may happen that the blocking arrangement of the fluid spring is unlocked without a user sitting on the chair. If a metal spring has been set at a high pre-tension, the spring will rapidly move the seat, together with its back, in an upward direction, which due to the pivot axis 37 being forwardly, also causes the back to move forwardly. This very fast movement may cause injury to a person who inadvertently had operated the unblocking arrangement. The chair, in accordance with the present invention, avoids such danger since a fluid spring inherently operates with a damped movement; it has, in general, a dashpot effect, so that the chair cannot snap fowardly, as it could if the spring were a mechanical spring.

The chair has an additional advantage: If service, lubrication or the like is required, it is only necessary to remove one of the attachment elements holding the spring, preferably a removable bolt 32 (FIG. 2) located at the attachment point 31 (FIG. 3) which is accessible without extensive difficulty from the side of the chair, when it is upright. Preferably, thus, the connection 31 is formed by a releasable bolt for the fluid element 27. Upon pulling out the bolt, the seat 17 can be tipped about axis 37 into the position shown in FIG. 2. The various elements of the seat mechanism are then easily accessible and can be, if desired, disassembled and replaced. Servicing, therefore, is easy.

In general, thus, the chair has a customary floor support such as a spider 11 with a central post 13, which may include a height adjustment mechanism, as well known, on which the support element 21 (FIG. 3) is located. The support element 21 can be, essentially, a channel structure of steel, to which a tubular extension is secured to fit together with the center post 13. The support 21 is inclined upwardly at a first angle of inclination which permits, upon pivoting of the seat about axis 37, lowering of the seat 17 from the position shown in FIG. 1 to one in which the back is lower, thereby tilting the seat about the axis 37. The torsion spring arrangement 23 has the tendency to tilt the seat about the axis 37 upwardly into the position shown in FIG. 1, or even higher, unless blocked. A gas spring or hydraulic spring 27 is used as the blocking arrangement, which can be re-set by releasing the blocking effect upon operation of the pushbutton 28 and a suitable linkage to the respective spring element 27. The fluid spring 27 is so located between the support 21 and the seat frame 29 that it extends in the general direction of the support 21, however at a greater angle of inclination than the support 21. The result will be a chair construction in which the central space beneath the seat 17 is free from mechanical parts. Consequently, the chair design can have an entirely pleasing aspect without distracting and clearly visible mechanical components.

Various changes and modifications may be made, and any features described herein may be used with any others, within the scope of the inventive concept.

I claim:

1. Rocking or swivel chair, particularly office chair, having a seat (17);

a floor support (11, 13);

an elongated seat support (21) coupled to the floor support at a first end portion thereof;

a torsion spring system (23) coupled to both said seat support (21) adjacent a second end portion thereof and said seat (17), said torsion spring system being deflectable about a tilt axis (37), and said seat being tiltably secured to said seat support for tilting movement about said tilt axis (37), said torsion spring system resiliently biassing said seat (17) to tilt or pivot the seat from a lower tilt position to an elevated tilt position;

spring tension setting means (25) coupled to said torsion spring system to set a bias spring tension therefor; and an elongated position setting and blocking means (27) located between said seat support (21) and said seat to block tilting of said seat for positioning said seat at least in or between two tilt positions, and wherein said position setting and blocking means (27) comprises a fluid blocking element (27);

a first end of said fluid blocking element being secured to said seat support (21) at a position between said second end portion and up to or at the first end portion thereof; and a second end of said fluid blocking element (27) being secured to said seat (17) at a position such that the elongated fluid blocking element extends in the general direction of the elongated seat support (21) and forms an acute angle with respect to said seat support.

2. The chair of claim 1, wherein said fluid blocking element (27) comprises a gas spring.

3. The chair of claim 1, wherein said fluid blocking element (27) comprises a hydraulic spring.

4. The chair of claim 1, wherein said elongated support (21) is coupled to said floor support (11, 13) such that it projects therefrom at an upwardly inclined angle; and wherein said fluid blocking element (27) projects from said elongated seat support at an angle which is somewhat greater than said upwardly inclined angle of the seat support.

5. The chair of claim 1, wherein the spring tension setting means (25) includes a wedge (53);

an adjustment spindle (51) shifting said wedge;

and means (45) to transfer a positioning force from said wedge (53) to said torsion spring (39).

6. The chair of claim 5, wherein said adjustment spindle (51) is located underneath the seat (17);

and a control knob (63) located at an end of the spindle (51).

7. The chair of claim 5, wherein said adjustment spindle extends laterally with respect to said seat;

and an axially shiftable adjustment knob (63) is coupled to the spindle (51), said axially shiftable adjustment knob having an axial adjustment position laterally of said seat to permit adjustment of the spring tension of said torsion spring (23, 39) by the user while the user is seated on the chair.

8. The chair of claim 1, including pivot means (31, 32, 33) coupling said fluid blocking element (27) at the respective ends thereof to, respectively, said seat support (21) and said seat (17);

and wherein at least one (32) of said pivot means is removable to permit tilting of said seat (17) about said tilt axis (37) about an arc of about 180°.

9. The chair of claim 1, wherein said tilt axis (37) is located adjacent and in the immediate vicinity of the forward edge of the seat (17).

10. The chair of claim 1, wherein the seat (17) includes a seat support structure (29), said seat support structure being tiltable or pivotable about said tilt axis (37).

11. The chair of claim 10, wherein said seat support (21), said torsion spring system (23), said torsion spring setting means (25), said fluid blocking element (27) and said seat support structure (29) form a single structural assembly.

12. The chair of claim 10, wherein the torsion spring system (23) includes a torsion rod (39) extending, effectively, transversely across the width of the seat (17);

two tubular elements (43, 44) are provided, positioned coaxially about the torsion rod (39) and coupled to the torsion rod at respective end portions of the torsion rod;

one of the tubular elements (43) being coupled to said elongated seat support (21);

positioned force transfer means (45) being provided, coupled to the other (44) of said tubular elements;

and wherein said seat support structure is pivotably located on said tubular elements (43, 44).

13. The chair of claim 12, wherein the other tubular element (44) is coupled to said positioning force transfer means (45), is rotatably positioned on said seat support (21).

14. The chair of claim 1, wherein the seat (17) includes a seat support structure (29), said seat support structure being tiltable or pivotable about said tilt axis (37);

wherein the torsion spring system (23) includes a torsion rod (39) extending, effectively, transversely across the width of the seat (17);

a first tubular element (43) located coaxially about the torsion rod (39) and secured thereto at one end thereof;

means (47) coupling the first tubular element (43) to said elongated seat support (21);

a second tubular element (44) coaxially about the torsion rod (39) and secured thereto at the second end thereof;

adjustable force transfer means (45) coupled to said second tubular element (44); and means (55, 57) coupling the force transfer means (45) to the seat support structure (29), and wherein said seat support structure is tiltable with respect to said first tubular element (43).

15. The chair of claim 14, including means (49) for rotatably positioning said second tubular element (44) on said seat support (21).

16. The chair of claim 14, wherein said fluid blocking element (27) comprises at least one of: a gas spring; a hydraulic spring.

17. The chair of claim 14, including pivot means (31, 32, 33) coupling said fluid blocking element (27) at the respective ends thereof to, respectively, said seat support (21) and said seat (17);

and wherein at least one (32) of said pivot means is removable to permit tilting of said seat (17) about said tilt axis (37) about an arc of about 180°.

18. The chair of claim 17, wherein said tilt axis (37) is located adjacent and in the immediate vicinity of the forward edge of the seat (17).

19. The chair of claim 14, wherein said second tubular element (44) extends towards said first tubular element and defines an inner region located beneath the seat support structure (29); and wherein the adjustable force transfer means is coupled to the second tubular element at said inner region.

20. The chair of claim 14, wherein said adjustable force transfer means (45) comprises a wedge (53);

an adjustment spindle (51) shifting said wedge;

a transfer arm (45) transferring a positioning force from said wedge to said second tubular element (44) and hence to said torsion rod (39);

a control knob (63) located at the end of the spindle, said spindle extending laterally with respect to said seat, and said control knob (63) being axially shiftable on said spindle to provide for an axial adjustment position of said control knob laterally of said seat to permit adjustment of spring tension of said torsion rod (39) by the user while the user is seated on the chair or, selectively, repositioning of said knob beneath the seat support structure (29).

* * * * *